US006093343A

United States Patent [19]

Addison et al.

[11] Patent Number: 6,093,343

[45] Date of Patent: Jul. 25, 2000

[54] DETERGENT PARTICLES COMPRISING METAL-CONTAINING BLEACH CATALYSTS

[75] Inventors: Michael Crombie Addison, Newcastle upon Tyne; Barry Rowland, Sunderland; Fiona Susan MacBeath, Newcastle upon Tyne, all of United Kingdom

[73] Assignee: The Procter & Gamble Company, Cincinnati, Ohio

[21] Appl. No.: 09/117,785

[22] PCT Filed: Jan. 31, 1997

[86] PCT No.: PCT/US97/01462

§ 371 Date: Aug. 7, 1998

§ 102(e) Date: Aug. 7, 1998

[87] PCT Pub. No.: WO97/29174

PCT Pub. Date: Aug. 14, 1997

[30] Foreign Application Priority Data

Feb. 18, 1996 [GB] United Kingdom ..... 9602578

[51] Int. Cl.[7] ..... C11D 3/395; C11D 7/54

[52] U.S. Cl. ..... 252/186.33; 510/311; 510/349; 510/376; 510/441; 510/445; 510/446; 510/508

[58] Field of Search ..... 510/311, 349, 510/376, 441, 445, 446, 508; 252/186.33

[56] References Cited

U.S. PATENT DOCUMENTS

| | | | |
|---|---|---|---|
| 4,536,183 | 8/1985 | Namnath | 8/107 |
| 5,114,611 | 5/1992 | Van Kralingen et al. | 252/186.33 |
| 5,244,594 | 9/1993 | Favre et al. | 252/186.33 |
| 5,441,660 | 8/1995 | Tsaur et al. | 252/95 |
| 5,703,034 | 12/1997 | Offshack et al. | 510/376 |
| 5,902,781 | 5/1999 | Painter | 510/220 |

FOREIGN PATENT DOCUMENTS

| | | | |
|---|---|---|---|
| 272030 | 6/1988 | European Pat. Off. | C11D 3/395 |
| 408131 | 1/1991 | European Pat. Off. | C11D 3/39 |
| 1961076 | 12/1969 | WIPO | C11D 1/86 |
| WO 94/21777 | 9/1994 | WIPO | C11D 3/39 |
| WO 95/28469 | 10/1995 | WIPO | C11D 3/386 |
| WO 96/17921 | 6/1996 | WIPO | C11D 3/39 |

*Primary Examiner*—Gregory R. Delcotto
*Attorney, Agent, or Firm*—C. Brant Cook; Kim William Zerby; Jacobus C. Rasser

[57] ABSTRACT

The present invention relates to bleach catalyst containing composite particles suitable for incorporation into particulate detergent compositions, said composite particles comprising by weight of the particles a) from 1% to 50% of a metal containing bleach catalyst; b) from 40% to 99% of an encapsulating material; and c) from 0.5% to 20% water.

9 Claims, No Drawings

DETERGENT PARTICLES COMPRISING METAL-CONTAINING BLEACH CATALYSTS

TECHNICAL FIELD

The present invention relates to bleach catalyst-containing particles, and to the preparation of these bleach catalyst-containing particles. These particles are particularly useful components of detergent compositions, such as laundry detergent compositions, hard surface cleaners, and especially automatic dishwashing detergent compositions.

BACKGROUND OF THE INVENTION

The use of certain bleach catalysts, particularly those comprising cobalt or manganese compounds, in detergent compositions has been previously suggested. A preferred way of incorporating such bleach catalyst components is in small particulate form. However, the direct incorporation of small bleach catalyst particles at typically very low levels into particulate detergent compositions can present problems. Such compositions typically, should be made up of particles having mean sizes which are all similar to each other in order to avoid segregation of components in the composition. Such compositions also often comprise particles having mean particles size in a defined range of from about 400 to about 2400 microns, more usually from about 500 to about 2000 microns, to achieve good flow and absence of dustiness properties. Any fine or oversize particles outside these limits must generally be removed by sieving to avoid a particle segregation problem. Fine bleach catalyst particles in a detergent composition matrix may also cause chemical stability problems caused by a tendency of the fine particles to interact with other components of the overall composition, such as other bleach components.

It has now been found that the above described problems may be surprisingly ameliorated by incorporating the bleach catalyst as composite particles in the form of microencapsulates which have a size distribution smaller to that of the other components of the particulate detergent composition, and which allow delivery of the bleach catalyst particle into the wash solution.

SUMMARY OF THE INVENTION

The present invention relates to bleach catalyst containing composite particles suitable for incorporation into particulate detergent compositions, said composite particles comprising by weight of the particles a) from 1% to 50% of the metal-containing bleach catalyst;
b) from 40% to 99% of the encapsulating material; and
c) from 0.5% to 20% water.

DETAILED DESCRIPTION OF THE INVENTION

The compositions according to the present invention comprise discrete particles of bleach catalyst and an encapsulating material. These particles may optionally contain other components, such as stabilizing additives and/or diluents. Each of these materials, the steps in the composite particle preparation process, the particles so prepared and particulate detergents containing these particles are described in detail hereinafter.

Metal-containing Bleach Catalysts:

The present composite particles comprise metal-containing bleach catalysts. Preferred are manganese and cobalt-containing bleach catalysts.

One type of metal-containing bleach catalyst is a catalyst system comprising a transition metal cation of defined bleach catalytic activity, such as copper, iron, titanium, ruthenium tungsten, molybdenum, or manganese cations, an auxiliary metal cation having little or no bleach catalytic activity, such as zinc or aluminum cations, and a sequestrate having defined stability constants for the catalytic and auxiliary metal cations, particularly ethylenediaminetetraacetic acid, (methylenephosphonic acid) and water-soluble salts thereof. Such catalysts are disclosed in U.S. Pat. No. 4,430,243.

Other types of bleach catalysts include the manganese-based complexes disclosed in U.S. Pat. No. 5,246,621 and U.S. Pat. No. 5,244,594. Preferred examples of these catalysts include $Mn^{IV}_2(u\text{-}O)_3$(1,4,7-trimethyl-1,4,7-triazacyclononane)$_2$-$(PF_6)_2$ ("MnTACN"), $Mn^{III}_2(u\text{-}O)_1(u\text{-}OAc)_2$(1,4,7-trimethyl-1,4,7-triazacyclononane)$_2$-$(ClO_4)_2$, $Mn^{IV}_4(u\text{-}O)_6$(1,4,7-triazacyclononane)$_4$-$(ClO_4)_2$, $Mn^{III}Mn^{IV}_4(u\text{-}O)_1(u\text{-}OAc)_2$-(1,4,7-trimethyl-1,4,7-triazacyclononane)$_2$-$(ClO_4)_3$, and mixtures thereof. See also European patent application publication no. 549,272. Other ligands suitable for use herein include 1,5,9-trimethyl-1,5,9-triazacyclododecane, 2-methyl-1,4,7-triazacyclononane, 2-methyl-1,4,7-triazacyclononane, and mixtures thereof.

Bleach catalysts of particular use in automatic dishwashing compositions and concentrated powder detergent compositions may also be selected as appropriate for the present invention. For examples of suitable bleach catalysts see U.S. Pat. No. 4,246,612 and U.S. Pat. No. 5,227,084.

See also U.S. Pat. No. 5,194,416 which teaches mononuclear manganese (IV) complexes such as Mn(1,4,7-trimethyl-1,4,7-triazacyclononane$(OCH_3)_3$-$(PF_6)$.

Still another type of bleach catalyst, as disclosed in U.S. Pat. No. 5,114,606, is a water-soluble complex of manganese (II), (III), and/or (IV) with a ligand which is a non-carboxylate polyhydroxy compound having at least three consecutive C—OH groups. Preferred ligands include sorbitol, iditol, dulsitol, mannitol, xylitol, arabitol, adonitol, meso-erythritol, meso-inositol, lactose, and mixtures thereof.

U.S. Pat. No. 5,114,611 teaches a bleach catalyst comprising a complex of transition metals, including Mn, Co, Fe, or Cu, with an non-(macro)-cyclic ligand. Said ligands are of the formula:

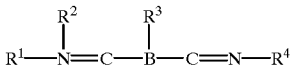

wherein $R^1$, $R^2$, $R^3$, and $R^4$ can each be selected from H, substituted alkyl and aryl groups such that each $R^1$—N═C—$R^2$ and $R^3$—C═N—$R^4$ form a five or six-membered ring. Said ring can further be substituted. B is a bridging group selected from O, S. $CR^5R^6$, $NR^7$ and C═O, wherein $R^5$, $R^6$, and $R^7$ can each be H, alkyl, or aryl groups, including substituted or unsubstituted groups. Preferred ligands include pyridine, pyridazine, pyrimidine, pyrazine, imidazole, pyrazole, and triazole rings. Optionally, said rings may be substituted with substituents such as alkyl, aryl, alkoxy, halide, and nitro. Particularly preferred is the ligand 2,2'-bispyridylamine. Preferred bleach catalysts include Co, Cu, Mn, Fe, -bispyridylmethane and -bispyridylamine complexes. Highly preferred catalysts include Co(2,2'-bispyridylamine)$Cl_2$, Di(isothiocyanato) bispyridylamine-cobalt (II), trisdipyridylamine-cobalt(II)

perchlorate, Co(2,2-bispyridylamine)$_2$O$_2$ClO$_4$, Bis-(2,2'-bispyridylamine) copper(II) perchlorate, tris(di-2-pyridylamine) iron(II) perchlorate, and mixtures thereof.

Other examples include Mn gluconate, $Mn(CF_3SO_3)_2$, $Co(NH_3)_5Cl$, and the binuclear Mn complexed with tetra-N-dentate and bi-N-dentate ligands, including $N_4Mn^{III}(u\text{-}O)_2Mn^{IV}N_4)^+$ and $[Bipy_2Mn^{III}(u\text{-}O)_2Mn^{IV}bipy_2]\text{-}(ClO_4)_3$.

The bleach catalysts may also be prepared by combining a water-soluble ligand with a water-soluble manganese salt in aqueous media and concentrating the resulting mixture by evaporation. Any convenient water-soluble salt of manganese can be used herein. Manganese (II), (III), (IV) and/or (V) is readily available on a commercial scale.

Other bleach catalysts are described, for example, in European patent application, publication no. 408,131 (cobalt complex catalysts), European patent applications, publication nos. 384,503, and 306,089 (metallo-porphyrin catalysts), U.S. Pat. No. 4,728,455 (manganese/multidentate ligand catalyst), U.S. Pat. No. 4,711,748 and European patent application, publication no. 224,952, (absorbed manganese on aluminosilicate catalyst), U.S. Pat. No. 4,601,845 (aluminosilicate support with manganese and zinc or magnesium salt), U.S. Pat. No. 4,626,373 (manganese/ligand catalyst), U.S. Pat. No. 4,119,557 (ferric complex catalyst), German Pat. specification 2,054,019 (cobalt chelant catalyst) Canadian 866,191 (transition metal-containing salts), U.S. Pat. No. 4,430,243 (chelants with manganese cations and non-catalytic metal cations), and U.S. Pat. No. 4,728,455 (manganese gluconate catalysts).

Preferred are cobalt (III) catalysts having the formula:

$$Co[(NH_3)_nM'_mB'_bT'_tQ_qP_p]Y_y$$

wherein cobalt is in the +3 oxidation state; n is an integer from 0 to 5 (preferably 4 or 5; most preferably 5); M' represents a monodentate ligand; m is an integer from 0 to 5 (preferably 1 or 2; most preferably 1); B' represents a bidentate ligand; b is an integer from 0 to 2; T' represents a tridentate ligand; t is 0 or 1; Q is a tetradentate ligand; q is 0 or 1; P is a pentadentate ligand; p is 0 or 1; and n+m+2b+3t+4q+5p=6; Y is one or more appropriately selected counteranions present in a number y, where y is an integer from 1 to 3 (preferably 2 to 3; most preferably 2 when Y is a −1 charged anion), to obtain a charge-balanced salt, preferred Y are selected from the group consisting of chloride, nitrate, nitrite, sulfate, citrate, acetate, carbonate, and combinations thereof; and wherein further at least one of the coordination sites attached to the cobalt is labile under automatic dishwashing use conditions and the remaining coordination sites stabilize the cobalt under automatic dishwashing conditions such that the reduction potential for cobalt (III) to cobalt (II) under alkaline conditions is less than about 0.4 volts (preferably less than about 0.2 volts) versus a normal hydrogen electrode.

Preferred cobalt catalysts of this type have the formula:

$$[Co(NH_3)_n(M')_m]Y_y$$

wherein n is an integer from 3 to 5 (preferably 4 or 5; most preferably 5); M' is a labile coordinating moiety, preferably selected from the group consisting of chlorine, bromine, hydroxide, water, and (when m is greater than 1) combinations thereof; m is an integer from 1 to 3 (preferably 1 or 2; most preferably 1); m+n=6; and Y is an appropriately selected counteranion present in a number y, which is an integer from 1 to 3 (preferably 2 to 3; most preferably 2 when Y is a −1 charged anion), to obtain a charge-balanced salt.

The preferred cobalt catalyst of this type useful herein are cobalt pentaamine chloride salts having the formula $[Co(NH_3)_5Cl]Y_y$, and especially $[Co(NH_3)_5Cl]Cl_2$.

More preferred are the present invention compositions which utilize cobalt (III) bleach catalysts having the formula:

$$[Co(NH_3)_n(M)_m(B)_b]T_y$$

wherein cobalt is in the +3 oxidation state; n is 4 or 5 (preferably 5); M is one or more ligands coordinated to the cobalt by one site; m is 0, 1 or 2 (preferably 1); B is a ligand coordinated to the cobalt by two sites; b is 0 or 1 (preferably 0), and when b=0, then m+n=6, and when b=1, then m=0 and n=4; and T is one or more appropriately selected counteranions present in a number y, where y is an integer to obtain a charge-balanced salt (preferably y is 1 to 3; most preferably 2 when T is a −1 charged anion); and wherein further said catalyst has a base hydrolysis rate constant of less than 0.23 $M^{-1}s^{-1}$ (25° C.).

Preferred T are selected from the group consisting of chloride, iodide, $I_3^-$, formate, nitrate, nitrite, sulfate, sulfite, citrate, acetate, carbonate, bromide, $PF_6^-$, $BF_4^-$, $B(Ph)_4^-$, phosphate, phosphite, silicate, tosylate, methanesulfonate, and combinations thereof. Optionally, T can be protonated if more than one anionic group exists in T, e.g., $HPO_4^{2-}$, $HCO_3^-$, $H_2PO_4^-$, etc. Further, T may be selected from the group consisting of non-traditional inorganic anions such as anionic surfactants (e.g., linear alkylbenzene sulfonates (LAS), alkyl sulfates (AS), alkylethoxysulfonates (AES), etc.) and/or anionic polymers (e.g., polyacrylates, polymethacrylates, etc.).

The M moieties include, but are not limited to, for example, $F^-$, $SO_4^{-2}$, $NCS^-$, $SCN^-$, $S_2O_3^{-2}$, $NH_3$, $PO_4^{3-}$, and carboxylates (which preferably are mono-carboxylates, but more than one carboxylate may be present in the moiety as long as the binding to the cobalt is by only one carboxylate per moiety, in which case the other carboxylate in the M moiety may be protonated or in its salt form). Optionally, M can be protonated if more than one anionic group exists in M (e.g., $HPO_4^{2-}$, $HCO_3^-$, $H_2PO_4^-$, HOC(O)CH$_2$C(O)O—, etc.) Preferred M moieties are substituted and unsubstituted $C_1$–$C_{30}$ carboxylic acids having the formulas:

$$RC(O)O—$$

wherein R is preferably selected from the group consisting of hydrogen and $C_1$–$C_{30}$ (preferably $C_1$–$C_{18}$) unsubstituted and substituted alkyl, $C_6$–$C_{30}$ (preferably $C_6$–$C_{18}$) unsubstituted and substituted aryl, and $C_3$–$C_{30}$ (preferably $C_5$–$C_{18}$) unsubstituted and substituted heteroaryl, wherein substituents are selected from the group consisting of —$NR'_3$, —$NR'_4^+$, —C(O)OR', —OR', — C(O)$NR'_2$, wherein R' is selected from the group consisting of hydrogen and $C_1$–$C_6$ moieties. Such substituted R therefore include the moieties —$(CH_2)_n$OH and —$(CH_2)_nNR'_4^+$, wherein n is an integer from 1 to about 16, preferably from about 2 to about 10. and most preferably from about 2 to about 5.

Most preferred M are carboxylic acids having the formula above wherein R is selected from the group consisting of hydrogen, methyl, ethyl, propyl, straight or branched $C_4$–$C_{12}$ alkyl, and benzyl. Most preferred R is methyl. Preferred carboxylic acid M moieties include formic, benzoic, octanoic, nonanoic, decanoic, dodecanoic, malonic, maleic, succinic, adipic, phthalic, 2-ethylhexanoic, naphthenoic, oleic, palmitic, triflate, tartrate, stearic, butyric, citric, acrylic, aspartic, fumaric, lauric, linoleic, lactic, malic, and especially acetic acid.

The B moieties include carbonate, di- and higher carboxylates (e.g., oxalate, malonate, malic, succinate, maleate), picolinic acid, and alpha and beta amino acids (e.g., glycine, alanine, beta-alanine, phenylalanine).

Cobalt bleach catalysts useful herein are known, being described for example along with their base hydrolysis rates, in M. L. Tobe, "Base Hydrolysis of Transition-Metal Complexes", *Adv. Inorg. Bioinorg. Mech.,* (1983), 2, pages 1–94. For example, Table 1 at page 17, provides the base hydrolysis rates (designated therein as $k_{OH}$) for cobalt pentaamine catalysts complexed with oxalate ($k_{OH}$=2.5×$10^{-4}$ $M^{-1}s^{-1}$ (25° C.)), $NCS^-$ ($k_{OH}$=5.0×$10^{-4}$ $M^{-1}s^{-1}$ (25° C.)), formate ($k_{OH}$=5.8×$10^{-4}$ $M^{-1}s^{-1}$ (25° C.)), and acetate ($k_{OH}$=9.6×$10^{-4}$ $M^{-1}s^{-1}$ (25° C.)). The most preferred cobalt catalyst useful herein are cobalt pentaamine acetate salts having the formula $[Co(NH_3)_5OAc]\ T_y$, wherein OAc represents an acetate moiety, and especially cobalt pentaamine acetate chloride, $[Co(NH_3)_5OAc]Cl_2$, as well as $[Co(NH_3)_5OAc](OAc)2$; $[Co(NH_3)_5OAc](PF_6)_2$; $[Co(NH_3)_5OAc](SO_4)$; $[Co(NH_3)_5OAc](BF_4)_2$; and $[Co(NH_3)_5OAc](NO_3)2$ (herein "PAC").

These cobalt catalysts are readily prepared by known procedures, such as taught for example in the Tobe article hereinbefore and the references cited therein, in U.S. Pat. No. 4,810,410, to Diakun et al, issued Mar. 7, 1989, *J. Chem. Ed.* (1989), 66 (12), 1043–45; The Synthesis and Characterization of Inorganic Compounds, W. L. Jolly (Prentice-Hall; 1970), pp. 461–3; *Inorg. Chem.,* 18, 1497–1502 (1979); *Inorg. Chem.,* 21, 2881–2885 (1982); *Inorg. Chem.,* 18, 2023–2025 (1979); Inorg. Synthesis, 173–176 (1960); and *Journal of Physical Chemistry,* 56, 22–25 (1952); as well as the synthesis examples provided hereinafter.

The bleach catalyst-containing composite particles of the invention comprise from 1 to 50%, preferably from 2% to 30%, most preferably from 3% to 25% by weight of the metal-containing bleach catalyst.

As a practical matter, and not by way of limitation, the cleaning compositions and cleaning processes herein can be adjusted to provide on the order of at least one part per hundred million of the active bleach catalyst species in the aqueous washing medium, and will preferably provide from about 0.01 ppm to about 25 ppm, more preferably from about 0.05 ppm to about 10 ppm, and most preferably from about 0.1 ppm to about 5 ppm, of the bleach catalyst species in the wash liquor. In order to obtain such levels in the wash liquor of an automatic dishwashing process, typical automatic dishwashing compositions herein will comprise from about 0.0005% to about 0.2%, more preferably from about 0.004% to about 0.08%, of bleach catalyst by weight of the cleaning compositions.

Micro-encapsulates

The bleach catalyst-containing composite particles are comprised of from 40% to 99% by weight, preferably 50% to 98% by weight, most preferably 60% to 97% by weight encapsulating material.

The encapsulating material should be inert to reaction with the bleach catalyst component of the particle under processing conditions and after solidification. Furthermore the encapsulating material is preferably water-soluble. Additionally, the encapsulating material should be substantially free of moisture present as unbound water.

Examples of suitable encapsulating materials include gelatine, hydrolyzed gelatine, film forming carbohydrates. Preferred encapsulating materials are low-bloom gelatin, hydrolyzed gelatine, and film-forming carbohydrates including dextrin and gum Arabic.

The metal-containing bleach catalyst encapsulated composition described above can be prepared by a method comprising:

(1) dissolving the metal-containing bleach catalyst in an aqueous medium, (2) mixing the metal-containing bleach catalyst solution with an aqueous solution of the encapsulating material, (3) converting the mixture thus obtained into droplets of an average particle size not exceeding 450 micrometer and (4) reducing the moisture content of said particles to a value of between 0.5% and 20% by weight to form a solid solution of the metal-containing bleach catalyst in the encapsulating material.

The encapsulating material should preferably have a molecular weight which is substantially higher than that of the metal-containing bleach catalyst. Thus, if the size of the molecules of the metal-containing bleach catalyst is less than about 0.6 of that of the encapsulating material, an extensive interstitial solid solution i.e. a solid solution in which the solute molecules occupy the interstitial space of the solvent lattice is obtained.

The conversion of the mixture into droplets and the reduction of the moisture content of the droplets are preferably effected by a spray-drying technique.

In a preferred embodiment of the method of the invention the mixture is spray-dried at an elevated temperature of below 100° C. while introducing a fine powder into the spray drying zone, as explained in US patent specification no. 2,756,177. The fine powder can be silicate or finely divided corn starch, preferably finely divided corn starch.

In another preferred embodiment the mixture is spray-dried at a temperature of above 100° C.

In a preferred embodiment, sugar (saccharose) or glucose syrup can be added to the mixture to be spray-dried in order to lower the viscosity of the mixture, the weight ratio of encapsulating material to sugar being at least 35:65, preferably 50:50.

Preferably an oil such as coconut oil is incorporated in the mixture to be spray-dried in the form of an emulsion. The presence of the oil facilitates the formation of droplets when the mixture is spray-dried, and amounts of from 2% to 20% by weight, preferably 3% to 10% by weight are used. The most preferred amount of oil is 5% by weight.

The dry matter content of the mixture to be spray-dried may vary within wide ranges but the viscosity is preferably maintained within the range of from 70 cp to 200 cp at 60° C.

Preferably, the composite particles herein have a particle size of from 10 to 450 micrometers.

Compositions, including detergent compositions herein, preferably contain composite particles having a particle size distribution such that at least 50% by weight of the particles have a particle size in the range of from 10 to 450 micrometers.

Detergent Compositions

The micro-encapsulated particles herein are useful components of detergent compositions, particularly those designed for use in automatic dishwashing methods.

Detergent compositions according to the invention preferably contains the bleach catalyst composition described above in an amount of from 2 ppm to 1,000 ppm preferably from 10 ppm to 100 ppm by weight of detergent composition of the pure bleach catalyst by weight of the detergent composition.

The detergent composition may additionally contain detergent ingredients e.g. builder components, other bleaches, bleach activators, silicates, dispersant polymers, surfactants, enzyme stabilizers, suds suppressors, corrosion inhibitors, fillers, hydrotropes and perfumes.

A preferred granular or powdered detergent composition comprises by weight:

(a) from about 0.1% to about 10% of the bleach catalyst composite particles as hereinbefore described;
(b) a bleach component comprising from about 0.01% to about 8% (as available oxygen "AvO") of a peroxygen bleach;
(c) from about 0.1% to about 90% of a pH adjusting component consisting of water-soluble salt, builder or salt/builder mixture selected from the group consisting of the alkali and alkaline earth metal phosphates, carbonates, sesquicarbonates, citrates, bicarbonates, and hydroxides, citric acid and mixtures thereof;
(d) from about 3% to about 20% silicate (as $SiO_2$);
(e) from 0% to about 10% of a low-foaming nonionic surfactant, especially other than an amine oxide;
(f) from 0% to about 10% of a suds suppressor;
(g) from 0% to about 25% of a dispersant polymer.

Such compositions are typically formulated to provide an in-use wash solution pH from about 9.5 to about 11.5.

Bleaches

The fully-formulated detergent compositions herein preferably contain an oxygen bleaching source. Oxygen bleach is employed in an amount sufficient to provide from 0.01% to about 8%, preferably from about 0.1% to about 5.0%, more preferably from about 0.3% to about 4.0%, most preferably from about 0.5% to about 3% of available oxygen (AvO) by weight of the detergent composition.

Available oxygen of a detergent composition or a bleach component is the equivalent bleaching oxygen content thereof expressed as % oxygen. For example, commercially available sodium perborate monohydrate typically has an available oxygen content for bleaching purposes of about 15% (theory predicts a maximum of about 16%). Methods for determining available oxygen of a formula after manufacture share similar chemical principles but depend on whether the oxygen bleach incorporated therein is a simple hydrogen peroxide source such as sodium perborate or percarbonate, is an activated type (e.g., perborate with tetra-acetyl ethylenediamine) or comprises a performed peracid such as monoperphthalic acid. Analysis of peroxygen compounds is well-known in the art: see, for example, the publications of Swern, such as "Organic Peroxides", Vol. I, D. H. Swern, Editor; Wiley, New York, 1970, LC # 72–84965, incorporated by reference. See for example the calculation of "percent active oxygen" at page 499. This term is equivalent to the terms "available oxygen" or "percent available oxygen" as used herein.

The peroxygen bleaching systems useful herein are those capable of yielding hydrogen peroxide in an aqueous liquor. These compounds include but are not limited to the alkali metal peroxides, organic peroxide bleaching compounds such as urea peroxide and inorganic persalt bleaching compounds such as the alkali metal perborates, percarbonates, perphosphates, and the like. Mixtures of two or more such bleaching compounds can also be used.

Preferred peroxygen bleaching compounds include sodium perborate, commercially available in the form of mono-, tri-, and tetra-hydrate, sodium pyrophosphate peroxyhydrate, urea peroxyhydrate, sodium percarbonate, and sodium peroxide. Particularly preferred are sodium perborate tetrahydrate, sodium perborate monohydrate and sodium percarbonate.

Suitable oxygen-type bleaches are further described in U.S. Pat. No. 4,412,934 (Chung et al), issued Nov. 1, 1983, and peroxyacid bleaches described in European Patent Application 033,259. Sagel et al, published Sep. 13, 1989, both incorporated herein by reference, can be used.

Highly preferred percarbonate can be in uncoated or coated form. The average particle size of uncoated percarbonate ranges from about 400 to about 1200 microns, most preferably from about 400 to about 600 microns. If coated percarbonate is used, the preferred coating materials include carbonate, sulfate, silicate, borosilicate, fatty carboxylic acids, and mixtures thereof.

Preferably, the peroxygen bleach component in the composition is formulated with an activator (peracid precursor). The activator is present at levels of from about 0.01% to about 15%, preferably from about 1% to about 10%, more preferably from about 1% to about 8%, by weight of the composition. Preferred activators are selected from the group consisting of tetraacetyl ethylene diamin (TAED), benzoylcaprolactam (BzCL), 4-nitrobenzoylcaprolactam, 3-chlorobenzoylcaprolactam, benzoyloxybenzenesulphonate (BOBS), nonanoyloxybenzenesulphonate (NOBS), phenyl benzoate (PhBz), decanoyloxybenzenesulphonate ($C_{10}$-OBS), benzoylvalerolactam (BZVL), octanoyloxybenzenesulphonate ($C_8$-OBS), perhydrolyzable esters and mixtures thereof, most preferably benzoylcaprolactam and benzoylvalerolactam. Particularly preferred bleach activators in the pH range from about 8 to about 9.5 are those selected having an OBS or VL leaving group.

Preferred bleach activators are those described in U.S. Pat. No. 5,130,045, Mitchell et al, and U.S. Pat. No. 4,412,934, Chung et al, and copending patent applications U.S. Ser. Nos. 08/064,624, 08/064,623, 08/064,621, 08/064,562, 08/064,564, 08/082,270 and copending application to M. Burns, A. D. Willey, R. T. Hartshorn, C. K. Ghosh, entitled "Bleaching Compounds Comprising Peroxyacid Activators Used With Enzymes" and having U.S. Ser. No. 08/133,691 (P&G Case 4890R), all of which are incorporated herein by reference.

The mole ratio of peroxygen bleaching compound (as AvO) to bleach activator in the present invention generally ranges from at least 1:1, preferably from about 20:1 to about 1:1, more prefer ably from about 10:1 to about 3:11.

Quaternary substituted bleach activators may also be included. The present detergent compositions comprise a quaternary substituted bleach activator (QSBA) or a quaternary substituted peracid (QSP); more preferably, the former. Preferred QSBA structures are further described in copending U.S. Ser. No. 08/298,903, 08/298,650, 08/298,906 and 08/298,904 filed Aug. 31, 1994, incorporated herein by reference.

Diacyl Peroxide Bleaching Species

The compositions in accordance with the present invention may also comprise a diacylperoxide bleach. The diacyl peroxides are added separately to the compositions at levels from about 0.01% to about 15% The individual diacyl peroxide particles used herein preferably have a mean particle size of less than about 300 microns, preferably less than about 200 microns, more preferably from about 1 to about 150 microns, most preferably from about 10 to about 100 microns.

The diacyl peroxide is preferably a diacyl peroxide of the general formula:

$$RC(O)OO(O)CR^1$$

wherein R and $R^1$ can be the same or different, and each comprises a hydrocarbyl group containing more than ten carbon atoms. Preferably, at least one of these groups has an aromatic nucleus.

Examples of suitable diacyl peroxides are those selected from the group consisting of dibenzoyl peroxide ("benzoyl peroxide"), benzoyl glutaryl peroxide, benzoyl succinyl peroxide, di-(2-methybenzoyl) peroxide, diphthaloyl peroxide an d mixtures thereof, more preferably dibenzoyl peroxide, diphthaloyl peroxides and mixtures thereof. The preferred diacyl peroxide is dibenzoyl peroxide.

The diacyl peroxide thermally decomposes under wash conditions (i.e. typically from about 38° C. to about 71° C.) to form free radicals. This occurs even when the diacyl peroxide particles are water-insoluble.

Surprisingly, particle size can play an important role in the performance of the diacyl peroxide, not only in preventing residue deposit problems, but also in enhancing the removal of stains, particularly from stained plasticware. The mean particle size of the diacyl peroxide particles produced in wash solution after dissolution of t he particle composite carrier material, as measured by a laser particle size analyzer (e.g. Malvern) on an agitated mixture with water of the diacyl peroxide, is less than about 300 microns, preferably less than about 200 microns. Although water insolubility is an essential characteristic of the diacyl peroxide used in the present invention, the size of the particles containing it is also important for controlling residue formation in the wash and maximizing stain removal performance.

Preferred diacyl peroxides used in the present compositions are also formulated into a carrier material that melts within the range of from about 38° C. to about 77° C., preferably selected from the group consisting of polyethylene glycols, paraffin waxes, and mixtures thereof, as taught in copending U.S. patent application Ser. No. 08/424,132, filed Apr. 17, 1995.

pH-Adjusting Control/Detergency Builder Components

The detergent compositions herein will preferably provide wash solutions having a pH of at least 7; therefore the compositions will typically comprise a pH-adjusting detergency builder component selected from water-soluble alkaline inorganic salts and water-soluble organic or inorganic builders. A wash solution pH of from 7 to about 13, preferably from about 8 to about 12, more preferably from about 8 to about 11.0 is desirable. The pH-adjusting components are selected so that when the detergent composition is dissolved in water at a concentration of 2000–6000 ppm, the pH remains in the ranges discussed above. The preferred non phosphate pH-adjusting component embodiments of the invention is selected from the group consisting of:

(i) sodium/potassium carbonate or sesquicarbonate
(ii) sodium/potassium citrate
(iii) citric acid
(iv) sodium/potassium bicarbonate
(v) sodium/potassium borate, preferably borax
(vi) sodium/potassium hydroxide;
(vii) sodium/potassium silicate and
(viii) mixtures of (i)–(vii).

Illustrative of highly preferred pH-adjusting component systems are binary mixtures of granular sodium citrate dihydrate with anhydrous sodium carbonate, and three-component mixtures of granular sodium citrate dihydrate, sodium carbonate and sodium disilicate.

The amount of the pH adjusting component included in the detergent compositions is generally from about 0.9% to about 99%, preferably from about 5% to about 70%, more preferably from about 20% to about 60% by weight of the composition.

Any pH-adjusting system can be complemented (i.e. for improved sequestration in hard water) by other optional detergency builder salts selected from phosphate or non-phosphate detergency builders known in the art, which include the various water-soluble, alkali metal, ammonium or substituted ammonium borates, hydroxysulfonates, polyacetates, and polycarboxylates. Preferred are the alkali metal, especially sodium, salts of such materials. Alternate water-soluble, non-phosphorus organic builders can be used for their sequestering properties. Examples of polyacetate and polycarboxylate builders are the sodium, potassium, lithium, ammonium and substituted ammonium salts of ethylenediamine tetraacetic acid, ethylenediamine disuccinic acid (especially the S,S-form); nitrilotriacetic acid, tartrate monosuccinic acid, tartrate disuccinic acid, oxydiacetic acid, oxydisuccinic acid, carboxymethyloxysuccinic acid, mellitic acid, and sodium benzene polycarboxylate salts.

The detergency builders can be any of the detergency builders known in the art, which include the various water-soluble, alkali metal, ammonium or substituted ammonium phosphates, polyphosphates, phosphonates, polyphosphonates, carbonates, borates, polyhydroxysulfonates, polyacetates, carboxylates (e.g. citrates), aluminosilicates and polycarboxylates. Preferred are the alkali metal, especially sodium, salts of the above and mixtures thereof.

Specific examples of inorganic phosphate detergency builders which also serve to adjust pH are sodium ("STPP") and potassium tripolyphosphates, pyrophosphate, polymeric metaphosphate having a degree of polymerization of from about 6 to 21, and orthophosphate. Examples of polyphosphonate builders are the sodium and potassium salts of ethylene diphosphonic acid, the sodium and potassium salts of ethane 1-hydroxy-1, 1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137, 3,400,176 and 3,400,148, incorporated herein by reference.

Non-phosphate detergency builders include but are not limited to the various water-soluble, alkali metal, ammonium or substituted ammonium borates, hydroxysulfonates, polyacetates, and polycarboxylates. Preferred are the alkali metal, especially sodium, salts of such materials. Alternate water-soluble, non-phosphorus organic builders can be used for their sequestering properties. Examples of polyacetate and polycarboxylate builders are the sodium, potassium, lithium, ammonium and substituted ammonium salts of ethylenediamine tetraacetic acid, ethylenediamine disuccinic acid (especially the S,S-form); nitrilotriacetic acid, tartrate monosuccinic acid, tartrate disuccinic acid, oxydisuccinic acid, carboxymethyloxysuccinic acid, mellitic acid, and sodium benzene polycarboxylate salts.

In general, the pH values of the detergent compositions can vary during the course of the wash as a result of the water and soil present. The best procedure for determining whether a given composition has the herein-indicated pH values is as follows: prepare an aqueous solution or dispersion of all the ingredients of the composition by mixing them in finely divided form with the required amount of water to have a 3000 ppm total concentration. Measure the pH using a conventional glass electrode at ambient temperature, within about 2 minutes of forming the solution or dispersion. To be clear, this procedure relates to pH measurement and is not intended to be construed as limiting of the detergent compositions in any way; for example, it is clearly envisaged that fully-formulated embodiments of the instant detergent compositions may comprise a variety of ingredients applied as coatings to other ingredients.

Silicates

The compositions of the type described herein optionally, but preferably comprise alkali metal silicates and/or metasilicates. The alkali metal silicates hereinafter described provide pH adjusting capability (as described above), protection against corrosion of metals and against attack on dishware, inhibition of corrosion to glasswares and chinawares. The $SiO_2$ level is from about 0.5% to about 20%, preferably from about 1% to about 15%, more preferably from about 2% to about 12%, most preferably from about 3% to about 10%, based on the weight of the detergent composition.

The ratio of $SiO_2$ to the alkali metal oxide ($M_2O$, where M=alkali metal) is typically from about 1 to about 3.2, preferably from about 1 to about 3, more preferably from about 1 to about 2.4. Preferably, the alkali metal silicate is hydrous, having from about 15% to about 25% water, more preferably, from about 17% to about 20%. Metasilicate having an $SiO_2$:$M_2O$ ratio of about 1:1 is also useful.

Anhydrous forms of the alkali metal silicates with a $SiO_2$:$M_2O$ ratio of 2.0 or more are also less preferred because they tend to be significantly less soluble than the hydrous alkali metal silicates having the same ratio. Sodium and potassium, and especially sodium, silicates are preferred. A particularly preferred alkali metal silicate is a granular hydrous sodium silicate having a $SiO_2$:$Na_2O$ ratio of from 2.0 to 2.4 available from PQ Corporation, named Britesil H20 and Britesil H24. Most preferred is a granular hydrous sodium silicate having a $SiO_2$:$Na_2O$ ratio of 2.0. While typical forms, i.e. powder and granular, of hydrous silicate particles are suitable, preferred silicate particles have a mean particle size between about 300 and about 900 microns with less than 40% smaller than 150 microns and less than 5% larger than 1700 microns. Particularly preferred is a silicate particle with a mean particle size between about 400 and about 700 microns with less than 20% smaller than 150 microns and less than 1% larger than 1700 microns.

Other suitable silicates include the crystalline layered sodium silicates have the general formula:

$$NaMSi_xO_{2x+1,y}H_2O$$

wherein M is sodium or hydrogen, x is a number from 1.9 to 4 and y is a number from 0 to 20. Crystalline layered sodium silicates of this type are disclosed in EP-A-0164514 and methods for their preparation are disclosed in DE-A-3417649 and DE-A-3742043. For the purpose of the present invention, x in the general formula above has a value of 2, 3 or 4. The most preferred material is $\delta$-$Na_2Si_2O_5$, available from Hoechst AG as NaSKS-6.

The crystalline layered sodium silicate material is preferably present in granular detergent compositions as a particle in intimate admixture with a solid, water-soluble ionisable material. The solid, water-soluble ionisable material is selected from organic acids, organic and inorganic acid salts and mixtures thereof.

Low-Foaming Nonionic Surfactant

Detergent compositions of the present invention can comprise low foaming nonionic surfactants (LFNIs). LFNI can be present in amounts from 0 to about 10% by weight, preferably from about 1% to about 8%. more preferably from about 0.25% to about 4%. LFNIs are most typically used in detergent compositions on account of the improved water-sheeting action (especially from glass) which they confer to the detergent composition product. They also encompass non-silicone, nonphosphate polymeric materials further illustrated hereinafter which are known to defoam food soils encountered in automatic dishwashing.

Preferred LFNIs include nonionic alkoxylated surfactants, especially ethoxylates derived from primary alcohols, and blends thereof with more sophisticated surfactants, such as the polyoxypropylene/polyoxyethylene/polyoxypropylene reverse block polymers. The PO/EO/PO polymer-type surfactants are well-known to have foam suppressing or defoaming action, especially in relation to common food soil ingredients such as egg.

The invention encompasses preferred embodiments wherein LFNI is present, and wherein this component is solid at temperatures below about 100° F., more preferably below about 120° F.

In a preferred embodiment, the LFNI is an ethoxylated surfactant derived from the reaction of a monohydroxy alcohol or alkylphenol containing from about 8 to about 20 carbon atoms, excluding cyclic carbon atoms, with from about 6 to about 15 moles of ethylene oxide per mole of alcohol or alkyl phenol on an average basis.

A particularly preferred LFNI is derived from a straight chain fatty alcohol containing from about 16 to about 20 carbon atoms ($C_{16}$–$C_{20}$ alcohol), preferably a $C_{18}$ alcohol, condensed with an average of from about 6 to about 15 moles, preferably from about 7 to about 12 moles, and most preferably from about 7 to about 9 moles of ethylene oxide per mole of alcohol. Preferably the ethoxylated nonionic surfactant so derived has a narrow ethoxylate distribution relative to the average.

The LFNI can optionally contain propylene oxide in an amount up to about 15% by weight. Other preferred LFNI surfactants can be prepared by the processes described in U.S. Pat. No. 4,223,163, issued Sep. 16, 1980, Builloty, incorporated herein by reference.

Highly preferred detergent compositions herein wherein the LFNI is present make use of ethoxylated monohydroxy alcohol or alkyl phenol and additionally comprise a polyoxyethylene, polyoxypropylene block polymeric compound; the ethoxylated monohydroxy alcohol or alkyl phenol fraction of the LFNI comprising from about 20% to about 80%, preferably from about 30% to about 70%, of the total LFNI.

Suitable block polyoxyethylene-polyoxypropylene polymeric compounds that meet the requirements described herein before include those based on ethylene glycol, propylene glycol, glycerol, trimethylolpropane and ethylenediamine as initiator reactive hydrogen compound. Polymeric compounds made from a sequential ethoxylation and propoxylation of initiator compounds with a single reactive hydrogen atom, such as $C_{12-18}$ aliphatic alcohols, do not generally provide satisfactory suds control in the instant detergent compositions. Certain of the block polymer surfactant compounds designated PLURONIC® and TETRONIC® by the BASF-Wyandotte Corp., Wyandotte, Mich., are suitable in detergent composition compositions herein.

A particularly preferred LFNI contains from about 40% to about 70% of a polyoxypropylene/polyoxyethylene/polyoxypropylene block polymer blend comprising about 75%, by weight of the blend, of a reverse block co-polymer of polyoxyethylene and polyoxypropylene containing 17 moles of ethylene oxide and 44 moles of propylene oxide; and about 25%, by weight of the blend, of a block co-polymer of polyoxyethylene and polyoxypropylene initiated with trimethylolpropane and containing 99 moles of propylene oxide and 24 moles of ethylene oxide per mole of trimethylolpropane.

Suitable for use as LFNI in the detergent composition compositions are those LFNI having relatively low cloud points and high hydrophilic-lipophilic balance (HLB). Cloud points of 1% solutions in water are typically below about 32° C. and preferably lower, e.g., 0° C., for optimum control of sudsing throughout a full range of water temperatures.

LFNIs which may also be used include a $C_{18}$ alcohol polyethoxylate, having a degree of ethoxylation of about 8, commercially available SLF18 from Olin Corp. and any biodegradable LFNI having the melting point properties discussed herein above.

Anionic Co-surfactant

The automatic dishwashing detergent compositions herein can additionally contain an anionic co-surfactant. When present, the anionic co-surfactant is typically in an amount from 0% to about 10%, preferably from about 0.1% to about 8%, more preferably from about 0.5% to about 5%, by weight of the detergent composition.

Suitable anionic co-surfactants include branched or linear alkyl sulfates and sulfonates. These may contain from about 8 to about 20 carbon atoms. Other anionic cosurfactants include the alkyl benzene sulfonates containing from about 6 to about 13 carbon atoms in the alkyl group, and mono- and/or dialkyl phenyl oxide mono- and/or di-sulfonates wherein the alkyl groups contain from about 6 to about 16 carbon atoms. All of these anionic co-surfactants are used as stable salts, preferably sodium and/or potassium.

Preferred anionic co-surfactants include sulfobetaines, betaines, alkyl(polyethoxy)sulfates (AES) and alkyl (polyethoxy)carboxylates which are usually high sudsing. Optional anionic co-surfactants are further illustrated in published British Patent Application No. 2,116,199A; U.S. Pat. No. 4,005,027, Hartman; U.S. Pat. No. 4,116,851, Rupe et al; and U.S. Pat. No. 4,116,849, Leikhim, all of which are incorporated herein by reference.

Preferred alkyl(polyethoxy)-sulfate surfactants comprise a primary alkyl ethoxy sulfate derived from the condensation product of a $C_6$–$C_{18}$ alcohol with an average of from about 0.5 to about 20, preferably from about 0.5 to about 5, ethylene oxide groups. The $C_6$–$C_{18}$ alcohol itself is preferable commercially available. $C_{12}$–$C_{15}$ alkyl sulfate which has been ethoxylated with from about 1 to about 5 moles of ethylene oxide per molecule is preferred. Where the compositions of the invention are formulated to have a pH of between 6.5 to 9.3, preferably between 8.0 to 9, wherein the pH is defined herein to be the pH of a 1% solution of the composition measured at 20° C., surprisingly robust soil removal, particularly proteolytic soil removal, is obtained when $C_{10}$–$C_{18}$ alkyl ethoxysulfate surfactant, with an average degree of ethoxylation of from 0.5 to 5 is incorporated into the composition in combination with a proteolytic enzyme, such as neutral or alkaline proteases at a level of active enzyme of from 0.005% to 2%. Preferred alkyl (polyethoxy)sulfate surfactants for inclusion in the present invention are the $C_{12}$–$C_{15}$ alkyl ethoxysulfate surfactants with an average degree of ethoxylation of from 1 to 5, preferably 2 to 4, most preferably 3.

Conventional base-catalyzed ethoxylation processes to produce an average degree of ethoxylation of 12 result in a distribution of individual ethoxylates ranging from 1 to 15 ethoxy groups per mole of alcohol, so that the desired average can be obtained in a variety of ways. Blends can be made of material having different degrees of ethoxylation and/or different ethoxylate distributions arising from the specific ethoxylation techniques employed and subsequent processing steps such as distillation.

Alkyl(polyethoxy)carboxylates suitable for use herein include those with the formula $RO(CH_2CH_2O)x\ CH_2COO—M^+$ wherein R is a $C_6$ to $C_{25}$ alkyl group, x ranges from 0 to 10, preferably chosen from alkali metal, alkaline earth metal, ammonium, mono-, di-, and tri-ethanolammonium, most preferably from sodium, potassium, ammonium and mixtures thereof with magnesium ions. The preferred alkyl(polyethoxy)carboxylates are those where R is a $C_{12}$ to $C_{18}$ alkyl group.

Highly preferred anionic cosurfactants herein are sodium or potassium salt-forms for which the corresponding calcium salt form has a low Kraft temperature, e.g., 30° C. or below, or, even better, 20° C. or lower. Examples of such highly preferred anionic cosurfactants are the alkyl (polyethoxy)sulfates.

Detersive Enzymes (including enzyme adjuncts)

Enzymes included in the present detergent compositions for a variety of purposes, including removal of protein-based, carbohydrate-based, or triglyceride-based stains from surfaces such as textiles or dishes, for the prevention of refugee dye transfer, for example in laundering, and for fabric restoration. Suitable enzymes include proteases, amylases, lipases, cellulases, peroxidases, and mixtures thereof of any suitable origin, such as vegetable, animal, bacterial, fungal and yeast origin. Preferred selections are influenced by factors such as pH-activity and/or stability optima, thermostability, and stability to active detergents, builders and the like. In this respect bacterial or fungal enzymes ar e preferred, such as bacterial amylases and proteases, and fungal cellulases.

"Detersiveenzyme", as used herein, means any enzyme having a cleaning, stain removing or otherwise beneficial effect in an ADD, laundry, hard surface cleaning or personal care detergent composition. Preferred detersive enzymes are hydrolases such as proteases, amylases and lipases. Preferred enzymes for laundry purposes include, but are not limited to, proteases, cellulases, lipases and peroxidases. Highly preferred for automatic dishwashing are amylases and/or proteases, including both current commercially available types and improved types which, though more and more bleach compatible though successive improvements, have a remaining degree of bleach deactivation susceptibility.

Enzymes are normally incorporated into detergent or detergent additive compositions at levels sufficient to provide a "cleaning-effective amount" The term "cleaning effective amount" refers to any amount capable of producing a cleaning, stain removal, soil removal, whitening, deodorizing, or freshness improving effect on substrates such as fabrics, dishware and the like. In practical terms for current commercial preparations, typical amounts are up to about 5 mg by weight, more typically 0.01 mg to 3 mg, of active enzyme per gram of the detergent composition. Stated otherwise, the finished detergent compositions herein will typically comprise from 0.001% to 5%, preferably 0.01%–1% by weight of a commercial enzyme preparation. Accordingly, the composite particles herein will comprise from about 0.1% to about 15%, preferably from about 1% to about 10%, by weight of enzyme. Protease enzymes are usually present in such commercial preparations at levels sufficient to provide from 0.005 to 0.1 by Anson units (AU) of activity per gram of composition. For certain detergents, such as in automatic dishwashing, it may be desirable to increase the active enzyme content of the commercial preparation in order to minimize the total amount of non-catalytically active materials and thereby improve spotting/filming or other end-results.

Higher active levels may also be desirable in highly concentrated detergent formulations.

Suitable examples of proteases are the subtilisins which are obtained from particular strains of *B. subtilis* and *B. licheniformis*. One suitable protease is obtained from a strain of Bacillus, having maximum activity throughout the pH range of 8–12, developed and sold as ESPERASE® by Novo Industries A/S of Denmark, hereinafter "Novo". The preparation of this enzyme and analogous enzymes is described in GB 1,243,784 to Novo. Other suitable proteases include ALCALASE® and SAVINASE® from Novo and MAXATASE® from International Bio-Synthetics, Inc., The Netherlands; as well as Protease A as disclosed in EP 130,756 A, Jan. 9, 1985 and Protease B as disclosed in EP 303,761 A, Apr. 28, 1987 and EP 130,756 A, Jan. 9, 1985. See also a high pH protease from Bacillus sp. NCIMB 40338 described in WO 9318140 A to Novo. Enzymatic detergents comprising protease, one or more other enzymes, and a reversible protease inhibitor are described in WO 9203529 A to Novo. Other preferred proteases include those of WO 9510591 A to Procter & Gamble. When desired, a protease having decreased adsorption and increased hydrolysis is available as described in WO 9507791 to Procter & Gamble. A recombinant trypsin-like protease for detergents suitable herein is described in WO 9425583 to Novo.

In more detail, an especially preferred protease, referred to as "Protease D" is a carbonyl hydrolase variant having an amino acid sequence not found in nature, which is derived from a precursor carbonyl hydrolase by substituting a different amino acid for a plurality of amino acid residues at a position in said carbonyl hydrolase equivalent to position +76, preferably also in combination with one or more amino acid residue positions equivalent to those selected from the group consisting of +99, +101, +103, +104, +107, +123, +27, +105, +109, +126, +128, +135, +156, +166, +195, +197, +204, +206, +210, +216, +217, +218, +222, +260, +265, and/or +274 according to the numbering of *Bacillus amyloliquefaciens* subtilisin, as described in the patent applications of A. Baeck, et al, entitled "Protease-Containing Cleaning Compositions" having U.S. Ser. No. 08/322,676, and C. Ghosh, et al, "Bleaching Compositions Comprising Protease Enzymes" having U.S. Ser. No. 08/322,677, both filed Oct. 13, 1994.

Amylases suitable herein, especially for, but not limited to automatic dishwashing purposes, include, for example, x-amylases described in GB 1,296,839 to Novo; RAPIDASE®, International Bio-Synthetics, Inc. and TERMAMYL®, Novo. FUNGAMYL® from Novo is especially useful. Engineering of enzymes for improved stability, e.g., oxidative stability, is known. See, for example J. Biological Chem., Vol. 260, No. 11, June 1985, pp 6518–6521. Certain preferred embodiments of the present compositions can make use of amylases having improved stability in detergents such as automatic dishwashing types, especially improved oxidative stability as measured against a reference-point of TERMAMYL® in commercial use in 1993. These preferred amylases herein share the characteristic of being "stability-enhanced" amylases, characterized, at a minimum, by a measurable improvement in one or more of: oxidative stability, e.g., to hydrogen peroxide/tetraacetylethylenediamine in buffered solution at pH 9–10; thermal stability, e.g., at common wash temperatures such as about 60° C.; or alkaline stability, e.g., at a pH from about 8 to about 11, measured versus the above-identified reference-point amylase. Stability can be measured using any of the art-disclosed technical tests. See, for example, references disclosed in WO 9402597. Stability-enhanced amylases can be obtained from Novo or from Genencor International. One class of highly preferred amylases herein have the commonality of being derived using site-directed mutagenesis from one or more of the Baccillus amylases, especially the Bacillus α-amylases, regardless of whether one, two or multiple amylase strains are the immediate precursors. Oxidative stability-enhanced amylases vs. the above-identified reference amylase are preferred for use, especially in bleaching, more preferably oxygen bleaching, as distinct from chlorine bleaching, detergent compositions herein. Such preferred amylases include (a) an amylase according to the hereinbefore incorporated WO 9402597, Novo, Feb. 3, 1994, as further illustrated by a mutant in which substitution is made, using alanine or threonine, preferably threonine, of the methionine residue located in position 197 of the *B. licheniformis* alpha-amylase, known as TERMAMYL®, or the homologous position variation of a similar parent amylase, such as *B. amyloliquefaciens, B. subtilis,* or *B. stearothermophilus;* (b) stability-enhanced amylases as described by Genencor Internatonal in a paper entitled "Oxidatively Resistant alpha-Amylases" presented at the 207th American Chemical Society National Meeting, Mar. 13–17, 1994, by C. Mitchinson. Therein it was noted that bleaches in automatic dishwashing detergents inactivate alpha-amylases but that improved oxidative stability amylases have been made by Genencor from *B. licheniformis* NCIB8061. Methionine (Met) was identified as th e most likely residue to be modified. Met was substituted, one at a time, in positions 8, 15, 197, 256, 304, 366 and 438 leading to specific mutants, particularly important being, M197L and M197T with the M197T variant being the most stable expressed variant. Stability was measured in CASCADE® and SUNLIGHT®; (c) particularly preferred amylases herein include amylase variants having additional modification in the immediate parent as described in WO 9510603 A and are available from Novo as DURAMYL®. Other particularly preferred oxidative stability enhanced amylase include those described in WO 9418314 to Genencor International and WO 9402597 to Novo. Any other oxidative stability-enhanced amylase can be used, for example as derived by site-directed mutagenesis from known chimeric, hybrid or simple mutant parent forms of available amylases. Other preferred enzyme modifications are accessible. See WO 9509909 A to Novo.

Cellulases usable herein include both bacterial and fungal types, preferably having a pH optimum between 5 and 9.5. U.S. Pat. No. 4,435,307, Barbesgoard et al, Mar. 6, 1984, discloses suitable fungal cellulases from *Humicola insolens* or Humicola strain DSM1800 or a cellulase 212-producing fungus belonging to the genus Aeromonas, and cellulase extracted from the hepatopancreas of a marine mollusk, *Dolabella Auricula Solander.* Suitable cellulases are also disclosed in GB-A-2.075.028; GB-A-2.095.275 and DE-OS-2.247.832. CAREZYME® (Novo) is especially useful. See also WO 9117243 to Novo.

Suitable lipase enzymes for detergent usage include those produced by microorganisms of the Pseudomonas group, such as *Pseudomonas stutzeri* ATCC 19.154, as disclosed in GB 1,372,034. See also lipases in Japanese Patent Application 53,20487, laid open Feb. 24, 1978. This lipase is available from Amano Pharmaceutical Co. Ltd., Nagoya, Japan, under the trade name Lipase P "Amano" or "Amano-P." Other suitable commercial lipases include Amano-CES, lipases ex *Chromobacter viscosumit,* e.g. *Chromobacter viscosum* var. *lipolyticum* NRRLB 3673 from Toyo Jozo Co., Tagata, Japan; *Chromobacter viscosum* lipases from U.S. Biochemical Corp., U.S.A. and Disoynth Co., The Netherlands, and lipases ex *Pseudomonas gladioli.* LIPOLASE® enzyme derived from *Humicola lanuginosa* and commercially available from Novo, see also EP 341,947, is a preferred lipase for use herein. Lipase and amylase variants stabilized against peroxidase enzymes are described in WO 9414951 A to N ovo. See also WO 920524 9 and RD 94359044.

Cutinase enzymes suitable for use herein are described in WO 8809367 A to Genencor.

Peroxidase enzymes may be used in combination with oxygen sources, e.g., percarbonate, perborate, hydrogen peroxide, etc., for "solution bleaching" or prevention of transfer of dyes or pigments removed from substrates during the wash to other substrates present in the wash solution. Known peroxidases include horseradish peroxidase, ligninase, and haloperoxidases such as chloro- or bromo-peroxidase. Peroxidase-containing detergent compositions are disclosed in WO 89099813 A, Oct. 19, 1989 to Novo and WO 8909813 A to Novo.

A range of enzyme materials and means for their incorporation into synthetic detergent compositions is also disclosed in WO 9307263 A and WO 9307260 A to Genencor International, WO 8908694 A to Novo, and U.S. Pat. No. 3,553,139, Jan. 5, 1971 to McCarty et al. Enzymes are further disclosed in U.S. Pat. No. 4,101,457, Place et al, Jul. 18, 1978, and in U.S. Pat. No. 4,507,219, Hughes, Mar. 26, 1985. Enzyme materials useful for liquid detergent formulations, and their incorporation into such formulations, are disclosed in U.S. Pat. No. 4,261,868, Hora et al, Apr. 14, 1981. Enzymes for use in detergents can be stabilised by various techniques. Enzyme stabilisation techniques are disclosed and exemplified in U.S. Pat. No. 3,600,319, Aug. 17, 1971, Gedge et al, EP 199,405 and EP 200,586, Oct. 29, 1986, Venegas. Enzyme stabilisation systems are also described, for example, in U.S. Pat. No. 3,519,570. A useful Bacillus, sp. AC13 giving proteases, xylanases and cellulases, is described in WO 9401532 A to Novo.

Enzyme Stabilizing System

The enzyme-containing composite particles and/or overall detergent compositions herein may comprise from about 0.001% to about 20%, preferably from about 0.005% to about 8%, most preferably from about 0.01% to about 6%, by weight of an enzyme stabilizing system. The enzyme stabilizing sys tem can be any stabilizing system which is compatible with the detersive enzyme. Such a system may be inherently provided by other formulation actives, or be added separately, e.g., by the formulator or by a manufacturer of detergent-ready enzymes. Such stabilizing systems can, for example, comprise calcium ion, boric acid, propylene glycol, short chain carboxylic acids, boronic acids, and mixtures thereof, and are designed to address different stabilization problems depending on the type of enzyme and type of detergent composition.

One stabilizing approach is the use of water-soluble sources of calcium and/or magnesium ions in the composite particles or in the finished compositions which provide such ions to the enzymes. Calcium ions are generally more effective than magnesium ions and are preferred herein if only one type of cation is being used. Enzymatic detergent compositions may comprise from about 1 to about 30, preferably from about 2 to about 20, more preferably from about 8 to about 12 millimoles of calcium ion per kg of finished detergent composition, though variation is possible depending on factors including the multiplicity, type a nd levels of enzymes incorporated. Preferably water-soluble calcium or magnesium salts are employed, including for example calcium chloride, calcium hydroxide, calcium formate, calcium malate, calcium maleate, calcium hydroxide and calcium acetate; more generally, calcium sulfate or magnesium salts corresponding to the exemplified calcium salts may be used. Further increased levels of calcium and/or magnesium may of course be useful, for example for promoting the grease-cutting action of certain types of surfactant.

Another stabilizing approach is by use of borate species. See Severson, U.S. Pat. No. 4,537,706. Borate stabilizers, when used, may be at levels of up to 10% or more of the composite particles or the finished composition, though more typically levels of up to about 3% by weight of boric acid or other borate compounds such as borax or orthoborate are used. Substituted boric acids such as phenylboronic acid, butaneboronic acid, p-bromophenylboronic acid or the like can be used in place of boric acid and reduced levels of total boron in detergent compositions may be possible though the use of such substituted boron derivatives.

Stabilizing systems of certain cleaning compositions, for example ADD's, may further comprise from 0 to about 10%, preferably from about 0.01% to about 6% by weight, of chlorine bleach scavengers, added to prevent chlorine bleach species present in many water supplies from attacking and inactivating the enzymes, especially under alkaline conditions. While chlorine levels in water may be small, typically in the range from about 0.5 ppm to about 1.75 ppm, the available chlorine in the total volume of water that comes in contact with the enzyme, for example during dish- or fabric-washing, can be relatively large; accordingly, enzyme stability to chlorine in-use is sometimes problematic. Since perborate or percarbonate, which have the ability to react with chlorine bleach, may be present in certain of the instant compositions in amounts accounted for separately from the stabilizing system, the use of additional stabilizers against chlorine, may, most generally, not be essential, though improved results may be obtainable from their use. Suitable chlorine scavenger anions are widely known and readily available, and, if used, can be salts containing ammonium cations with sulfite, bisulfite, thiosulfite, thiosulfate, iodide, etc. Antioxidants such as carbamate, ascorbate, etc., organic amines such as ethylenediaminetetracetic acid (EDTA) or alkali metal salt thereof, monoethanolamine (MEA), and mixtures thereof can likewise be used. Likewise, special enzyme inhibition systems can be incorporated such that different enzymes have maximum compatibility. Other conventional scavengers such as bisulfate, nitrate, chloride, sources of hydrogen peroxide such as sodium perborate tetrahydrate, sodium perborate monohydrate and sodium percarbonate, as well as phosphate, condensed phosphate, acetate, benzoate, citrate, formate, lactate, malate, tartrate, salicylate, etc., and mixtures thereof can be used if desired. In general, since the chlorine scavenger function can be performed by ingredients separately listed under better recognized functions, (e.g., hydrogen peroxide sources), there is no absolute requirement to add a separate chlorine scavenger unless a compound performing that function to the desired extent is absent from an enzyme-containing embodiment of the invention; even then, the scavenger is added only for optimum results. Moreover, the formulator will exercise a chemist's normal skill in avoiding the use of any enzyme scavenger or stabilizer which is majorly incompatible, as formulated, with other reactive ingredients, if used. In relation to the use of ammonium salts, such salts can be simply admixed with the detergent composition but are prone to adsorb water and/or liberate ammonia during storage. Accordingly, such materials, if present, are desirably protected in a particle such as that described in U.S. Pat. No. 4,652,392, Baginski et al.

Silicone and Phosphate Ester Suds Suppressors

The detergent compositions optionally contain an alkyl phosphate ester suds suppressor, a silicone suds suppressor, or combinations thereof. Levels in general are from 0% to about 10%, preferably, from about 0.001% to about 5%. Typical levels tend to be low, e.g., from about 0.01% to about 3% when a silicone suds suppressor is used. Preferred non-phosphate compositions omit the phosphate ester component entirely.

Silicone suds suppressor technology and other defoaming agents useful herein are extensively documented in "Defoaming, Theory and Industrial Applications", Ed., P. R. Garrett, Marcel Dekker, N.Y., 1973, ISBN 0-8247–8770-6, incorporated herein by reference. See especially the chapters entitled "Foam control in Detergent Products" (Ferch et al) and "Surfactant Antifoams" (Blease et al). See also U.S. Pat. Nos. 3,933,672 and 4,136,045. Highly preferred silicone suds suppressors are the compounded types known for use in laundry detergents such as heavy-duty granules, although types hitherto used only in heavy-duty liquid detergents may also be incorporated in the instant compositions. For example, polydimethylsiloxanes having trimethylsilyl or alternate endblocking units may be used as the silicone. These may be compounded with silica and/or with surface-active nonsilicon components, as illustrated by a suds suppressor comprising 12% silicone/silica, 18% stearyl alcohol and 70% starch in granular form. A suitable commercial source of the silicone active compounds is Dow Corning Corp.

Levels of the suds suppressor depend to some extent on the sudsing tendency of the composition, for example, an detergent composition for use at 2000 ppm comprising 2% octadecyldimethylamine oxide may not require the presence of a suds suppressor. Indeed, it is an advantage of the present invention to select cleaning-effective amine oxides which are inherently much lower in foam-forming tendencies than the typical coco amine oxides. In contrast, formulations in which amine oxide is combined with a high-foaming anionic cosurfactant, e.g., alkyl ethoxy sulfate, benefit greatly from the presence of suds suppressors.

Phosphate esters have also been asserted to provide some protection of silver and silver-plated utensil surfaces, however, the instant compositions can have excellent silverware without a phosphate ester component. Without being limited by theory, it is believed that lower pH formulations, e.g., those having pH of 9.5 and below, plus the presence of the essential amine oxide, both contribute to improved silver care.

If it is desired nonetheless to use a phosphate ester, suitable compounds are disclosed in U.S. Pat. No. 3,314,891, issued Apr. 18, 1967, to Schmolka et al, incorporated herein by reference. Preferred alkyl phosphate esters contain from 16–20 carbon atoms. Highly preferred alkyl phosphate esters are monostearyl acid phosphate or monooleyl acid phosphate, or salts thereof, particularly alkali metal salts, or mixtures thereof.

It has been found preferable to avoid the use of simple calcium-precipitating soaps as antifoams in the present compositions as they tend to deposit on the dishware. Indeed, phosphate esters are not entirely free of such problems and the formulator will generally choose to minimize the content of potentially depositing antifoams in the instant compositions.

Corrosion Inhibitor

The detergent compositions may contain a corrosion inhibitor. Such corrosion inhibitors are preferred components of automatic dishwashing compositions in accord with the invention, and are preferably incorporated at a level of from 0.05% to 10%, preferably from 0.1% to 5% by weight of the total composition.

Suitable corrosion inhibitors include paraffin oil typically a predominantly branched aliphatic hydrocarbon having a number of carbon atoms in the range of from 20 to 50: preferred paraffin oil selected from predominantly branched $C_{25-45}$ species with a ratio of cyclic to noncyclic hydrocarbons of about 32:68; a paraffin oil meeting these characteristics is sold by Wintershall, Salzbergen, Germany, under the trade name WINOG 70.

Other suitable corrosion inhibitor compounds include benzotriazole and any derivatives thereof, mercaptans and diols, especially mercaptans with 4 to 20 carbon atoms including lauryl mercaptan, thiophenol, thionaphthol, thionalide and thioanthranol. Also suitable are the $C_{12}$–$C_{20}$ fatty acids, or their salts, especially aluminum tristearate. The $C_{12}$–$C_{20}$ hydroxy fatty acids, or their salts, are also suitable. Phosphonated octa-decane and other anti-oxidants such as betahydroxytoluene (BHT) are also suitable. Bismuth nitrate is also suitable.

Dispersant polymers

A dispersant polymer may optionally be used in the instant detergent compositions in the range from 0% to about 25%, preferably from about 0.5% to about 20%, more preferably from about 1% to about 7% by weight of the overall composition. Dispersant polymers are also useful for improved filming performance of the present ADD compositions, especially in higher pH embodiments, such as those in which wash pH exceeds about 9.5. Particularly preferred are polymers which inhibit the deposition of calcium carbonate or magnesium silicate on dishware.

Dispersant polymers suitable for use herein are illustrated by the film-forming polymers described in U.S. Pat. No. 4,379,080 (Murphy), issued Apr. 5, 1983, incorporated herein by reference.

Suitable polymers are preferably at least partially neutralized or alkali metal, ammonium or substituted ammonium (e.g., mono-, di- or triethanolammonium) salts of polycarboxylic acids. The alkali metal, especially sodium salts are most preferred. While the molecular weight of the polymer can vary over a wide range, it preferably is from about 1000 to about 500,000, more preferably is from about 1000 to about 250,000, and most preferably, especially if the detergent composition is for use in North American automatic dishwashing appliances, is from about 1000 to about 10,000.

Other suitable dispersant polymers include those disclosed in U.S. Pat. No. 3,308,067 issued Mar. 7, 1967, to Diehl, incorporated herein by reference. Unsaturated monomeric acids that can be polymerized to form suitable dispersant polymers include acrylic acid, maleic acid (or maleic anhydride), fumaric acid, itaconic acid, aconitic acid, mesaconic acid, citraconic acid and methylenemalonic acid. The presence of monomeric segments containing no carboxylate radicals such as methyl vinyl ether, styrene, ethylene, etc. is suitable provided that such segments do not constitute more than about 50% by weight of the dispersant polymer.

Copolymers of acrylamide and acrylate having a molecular weight of from about 3,000 to about 100,000, preferably from about 4,000 to about 20,000, and an acrylamide content of less than about 50%, preferably less than about 20%, by weight of the dispersant polymer can also be used. Most preferably, such dispersant polymer has a molecular weight of from about 4,000 to about 20,000 and an acrylamide content of from about 0% to about 15%, by weight of the polymer.

Particularly preferred dispersant polymers are low molecular weight modified polyacrylate copolymers. Such copolymers contain as monomer units: a) from about 90% to about 10%, preferably from about 80% to about 20% by weight acrylic acid or its salts and b) from about 10% to about 90%, preferably from about 20% to about 80% by weight of a substituted acrylic monomer or its salt and have the general formula: —[(C($R^2$)C($R^1$)(C(O)O$R^3$)]— wherein the incomplete valences inside the square braces are hydrogen and at least one of the substituents $R^1$, $R^2$ or $R^3$, preferably $R^1$ or $R^2$, is a 1 to 4 carbon alkyl or hydroxyalkyl group, $R^1$ or $R^2$ can be a hydrogen and $R^3$ can be a hydrogen or alkali metal salt. Most preferred is a substituted acrylic monomer wherein $R^1$ is methyl, $R^2$ is hydrogen and $R^3$ is sodium.

The low molecular weight polyacrylate dispersant polymer preferably has a molecular weight of less than about 15,000, preferably from about 500 to about 10,000, most preferably from about 1,000 to about 5,000. The most preferred polyacrylate copolymer for use herein has a molecular weight of 3500 and is the fully neutralized form of the polymer comprising about 70% by weight acrylic acid and about 30% by weight methacrylic acid.

Other suitable modified polyacrylate copolymers include the low molecular weight copolymers of unsaturated aliphatic carboxylic acids disclosed in U.S. Pat. Nos. 4,530,766, and 5,084,535, both incorporated herein by reference.

Other dispersant polymers useful herein include the polyethylene glycols and polypropylene glycols having a molecular weight of from about 950 to about 30,000 which can be obtained from the Dow Chemical Company of Midland, Michigan. Such compounds for example, having a melting point within the range of from about 30° to about 100° C. can be obtained at molecular weights of 1450, 3400, 4500, 6000, 7400, 9500, and 20,000. Such compounds are formed by the polymerization of ethylene glycol or propylene glycol with the requisite number of moles of ethylene or propylene oxide to provide the desired molecular weight and melting point of the respective polyethylene glycol and polypropylene glycol. The polyethylene, polypropylene and mixed glycols are referred to using the formula $HO(CH_2CH_2O)_m(CH_2CH(CH_3)O)_n(CH(CH_3)CH_2O)OH$ wherein m, n, and o are integers satisfying the molecular weight and temperature requirements given above.

Yet other dispersant polymers useful herein include the cellulose sulfate esters such as cellulose acetate sulfate, cellulose sulfate, hydroxyethyl cellulose sulfate, methylcellulose sulfate, and hydroxypropylcellulose sulfate. Sodium cellulose sulfate is the most preferred polymer of this group.

Other suitable dispersant polymers are the carboxylated polysaccharides, particularly starches, celluloses and alginates, described in U.S. Pat. No. 3,723,322, Diehl, issued Mar. 27, 1973; the dextrin esters of polycarboxylic acids disclosed in U.S. Pat. No. 3,929,107, Thompson, issued Nov. 11, 1975; the hydroxyalkyl starch ethers, starch esters, oxidized starches, dextrins and starch hydrolysates described in U.S. Pat. No. 3,803,285, Jensen, issued Apr. 9, 1974; the carboxylated starches described in U.S. Pat. No. 3,629,121, Eldib, issued Dec. 21, 1971; and the dextrin starches described in U.S. Pat. No. 4,141,841, McDanald, issued Feb. 27, 1979; all incorporated herein by reference. Preferred cellulose-derived dispersant polymers are the carboxymethyl celluloses.

Yet another group of acceptable dispersants are the organic dispersant polymers, such as polyaspartate.

Other Optional Adjuncts

Depending on whether a greater or lesser degree of compactness is required, filler materials can also be present in the detergent compositions. These include sucrose, sucrose esters, sodium chloride, sodium sulfate, potassium chloride, potassium sulfate, etc., in amounts up to about 70%, preferably from 0% to about 40% of the detergent composition. A preferred filler is sodium sulfate, especially in good grades having low levels of trace impurities.

Sodium sulfate used herein preferably has a purity sufficient to ensure it is non-reactive with bleach; it may also be treated with low levels of sequestrants, such as phosphonates in magnesium-salt form. Note that preferences, in terms of purity sufficient to avoid decomposing bleach, applies also to builder ingredients.

Hydrotrope materials such as sodium benzene sulfonate, sodium toluene sulfonate, sodium cumene sulfonate, etc., can be present in minor amounts.

Bleach-stable perfumes (stable as to odor); and bleach-stable dyes (such as those disclosed in U.S. Pat. No. 4,714,562, Roselle et al, issued Dec. 22, 1987); can also be added to the present compositions in appropriate amounts. Other common detergent ingredients are not excluded.

Since certain detergent compositions herein can contain water-sensitive ingredients, e.g., in embodiments comprising anhydrous amine oxides or anhydrous citric acid, it is desirable to keep the free moisture content of the detergent compositions at a minimum, e.g., 7% or less, preferably 4% or less of the detergent composition; and to provide packaging which is substantially impermeable to water and carbon dioxide. Plastic bottles, including refillable or recyclable types, as well as conventional barrier cartons or boxes are generally suitable. When ingredients are not highly compatible, e.g., mixtures of silicates and citric acid, it may further be desirable to coat at least one such ingredient with a low-foaming nonionic surfactant for protection. There are numerous waxy materials which can readily be used to form suitable coated particles of any such otherwise incompatible components.

Method for Cleaning

The detergent compositions herein may be utilized in methods for cleaning soiled tableware and laundry.

A preferred method for cleaning soiled tableware comprises contacting the tableware with a pH wash aqueous medium of at least 8. The aqueous medium preferably comprises at least about 0.1 ppm bleach catalyst and available oxygen from a peroxygen bleach.

A preferred method for cleaning soiled tableware comprises using the catalyst/enzyme-containing particles, low foaming surfactant and detergency builder. The aqueous medium is formed by dissolving a solid-form automatic dishwashing detergent in an automatic dishwashing machine. A particularly preferred method also includes low levels of silicate, preferably from about 3% to about 10% $SiO_2$.

EXAMPLE 1

3,240 g gelatine (Bloom strength O) and 3,240 g sugar were added to a 10% by weight solution of metal-containing bleach catalyst in 5,200 g water while stirring. Subsequently, 650 g coconut oil was emulsified in the solution thus obtained.

The dry matter content of the mixture thus prepared was about 60%, about 16% being metal-containing bleach catalyst and the viscosity was 96 cp at 55° C.

The mixture was spray-dried in a spray drying tower while simultaneously introducing corn starch therein as a powdering composition.

The mixture was introduced at a rate of 2 l/min. and the temperature of the spray drying zone was about 70° C.

The final product (about 9,200 g) was sieved and the mesh 30-mesh 120 (ASTM) fraction was collected and analyzed. The collected fraction contained 14.1% metal-containing bleach catalyst and the average particle diameter was about 350 micrometer.

EXAMPLE 2

2,388 g gelatine was dissolved in 2,135 g water by stirring and heating to a temperature of about 60° C. A solution of 126 g sodium hydroxide in 215 g water was added under stirring to the gelatine solution at a temperature of 60° C. After stirring for 20 min. at 60° C. 135 g concentrated sulfuric acid (96%) was added and the pH-value was adjusted at about 5.5. 900 g of the solution thus obtained ("hydrolyzed gelatine") was mixed with a solution of 100 g metal-containing bleach catalyst in 1,150 g water, 450 spray-dried glucose syrup ("Monsweet R 1924) and 50 g coconut oil while stirring at 55° C. When the coconut had been emulsified in the aqueous medium an additional amount of 700 g water was added. The dry matter content of the mixture thus obtained was about 30%, about 10% being metal-containing bleach catalyst. The viscosity of the mixture was about 50 cp at 600C. The mixture was spray-dried in a conventional spray-drying tower at an inlet temperature of 240° C. and an outlet temperature of 97° C.

The spray-dried product (about 900 g) was sieved and the sieve fraction having a particle size of less than 100 mesh (ASTM) was collected.

This fraction contained 9.7% metal-containing bleach catalyst and the average particle size was about 50 micrometer.

EXAMPLE 3

1060 g gum arabic and 1010 g sugar (saccharose) were added to a solution of 1375 g metal-containing bleach catalyst in 1850 g water while stirring. 138 g coconut oil was emulsified in the solution thus obtained.

The dry matter content of the mixture thus prepared was about 45%, about 11.4% being metal-containing bleach catalyst and the viscosity was 108 cP at 57° C.

The mixture was spray-dried in a spray drying tower while simultaneously introducing corn starch therein as a powdering composition.

The mixture was introduced at a rate of 1.5 l/min. and the temperature of the spray drying zone was about 65° C.

The final product (about 3500 g) was sieved and the mesh 30-mesh 170 (ASTM) fraction was collected and analysed.

The collected fraction contained 8.2% metal-containing bleach catalyst and the average particle diameter was about 250 micrometers.

In the compositions, the abbreviated component identifications have the following meanings:

| | |
|---|---|
| Nonionic | $C_{13}$–$C_{15}$ mixed ethoxylated/propoxylated fatty alcohol with an average degree of ethoxylation of 3.8 and an average degree of propoxylation of 4.5 sold under the tradename Plurafac LF404 by BASF GmbH (low foaming) |
| Metasilicate | Sodium metasilicate ($SiO_2$:$Na_2O$ ratio = 1.0) |
| Silicate | Amorphous Sodium Silicate ($SiO_2$:$Na_2O$ ratio = 2.0) |
| Carbonate | Anhydrous sodium carbonate |
| Phosphate | Sodium tripolyphosphate |
| 480N | Random copolymer of 3:7 acrylic/methacrylic acid, average molecular weight about 3,500 |
| Citrate | Tri-sodium citrate dihydrate |
| PB1 | Anhydrous sodium perborate monohydrate |
| TAED | Tetraacetyl ethylene diamine |
| Cationic precursor | Cationic peroxyacid bleach precursor salt of trialkyl ammonium methylene $C_5$-alkyl caprolactam with tosylate |
| BzP | Dibenzoyl peroxide |
| DETPMP | Diethylene triamine penta (methylene phosphonic acid), marketed by Monsanto under the tradename Dequest 2060 |

-continued

| | |
|---|---|
| HEDP | Ethane 1-hydroxy-1,1-diphosphonic acid |
| Bismuth nitrate | Bismuth nitrate salt |
| Bismuth (HEDP) | Complex of bismuth and HEDP |
| Paraffin | Paraffin oil sold under the tradename Winog 70 by Wintershall. |
| BD/MA | Copolymer of butadiene/maleic acid as sold by Polysciences inc under the tradename reference no. 07787 |
| Protease | Proteolytic enzyme sold under the tradename Savinase by Novo Industries A/S (approx 2% enzyme activity). |
| Amylase | Amylolytic enzyme sold under the tradename Termamyl 60T by Novo Industries A/S (approx 0.9% enzyme activity) |
| BSA | Amylolytic enzyme sold under the tradename LE17 by Novo Industries A/S (approx 1% enzyme activity) |
| Sulphate | Anhydrous sodium sulphate. |
| pH | Measured as a 1% solution in distilled water at 20° C. |

In the following examples all levels of enzyme quoted are expressed as % active enzyme by weight of the composition.

EXAMPLE 1

The following bleach-containing machine dishwashing compositions were prepared (parts by weight). Compositions A is a comparative composition, compositions B to G are in accord with the invention.

| | A | B | C | D | E | F | G |
|---|---|---|---|---|---|---|---|
| Citrate | 15.0 | 15.0 | 15.0 | 15.0 | 15.0 | 15.0 | — |
| 480N | 6.0 | 6.0 | 6.0 | 6.0 | 6.0 | 6.0 | — |
| Carbonate | 17.5 | 17.5 | 17.5 | 17.5 | 17.5 | 17.5 | — |
| Phosphate | — | — | — | — | — | — | 38.0 |
| Silicate (as $SiO_2$) | 8.0 | 8.0 | 8.0 | 8.0 | 8.0 | 8.0 | 14.0 |
| Metasilicate (as $SiO_2$) | 1.2 | 1.2 | 1.2 | 1.2 | 1.2 | 1.2 | 2.5 |
| PB1 (AvO) | 1.2 | 1.2 | 1.5 | 1.5 | 1.5 | 2.2 | 1.2 |
| Bleach catalyst encapsulate particle - formula given below | — | 0.2 | 0.1 | 0.05 | 0.1 | 0.2 | 0.3 |
| TAED | 2.2 | 2.2 | 2.2 | — | — | 2.2 | 2.2 |
| BzP | — | — | — | 0.8 | — | — | — |
| Cationic precursor | — | — | — | — | 3.3 | — | — |
| Paraffin | 0.5 | 0.5 | 0.5 | 0.5 | 0.5 | 0.5 | 0.5 |
| Bismuth nitrate | — | 0.2 | 0.2 | 0.2 | 0.3 | 0.4 | 0.2 |
| BD/MA | — | — | — | — | — | — | 0.5 |
| Protease | 0.04 | 0.04 | 0.04 | 0.04 | 0.04 | 0.04 | 0.04 |
| Amylase | 0.03 | 0.03 | 0.03 | 0.03 | 0.03 | 0.03 | — |
| BSA | — | — | — | — | — | — | 0.03 |
| DETPMP | 0.13 | 0.13 | 0.13 | 0.13 | 0.13 | 0.13 | — |
| HEDP | 1.0 | 1.0 | 1.0 | 1.0 | 1.0 | 1.0 | — |
| Nonionic | 2.0 | 2.0 | 2.0 | 2.0 | 2.0 | 2.0 | 1.5 |
| Sulphate | 23.0 | 22.8 | 22.4 | 22.7 | 22.2 | 21.5 | 0.3 |
| misc inc moisture to balance | | | | | | | |
| pH (1% solution) | 10.7 | 10.7 | 10.7 | 10.7 | 10.7 | 10.7 | 11.0 |

Encapsulate particles containing zero-bloom gelatin at a level of 96.6% and 3.4% pentaamineacetocobalt (III) nitrate bleach catalyst. Particle size of the encapsulates 10–450 micrometers.

What is claimed is:

1. A composite particle for incorporation into granular detergent compositions, said composite particle consisting of by weight of the particle:

(a) from 1% to 50% of a transition metal-containing bleach catalyst, selected from the group consisting of copper, cobalt, iron, titanium, ruthenium, tungsten, molybdenum, manganese catalysts, and mixtures thereof;

(b) from 40% to 99% of an encapsulating material, selected from the group consisting of gelatine, hydrolyzed gelatine, film forming carbohydrates, and mixtures thereof; and (c) from 0.5% to 20% water.

2. A composite particle according to claim 1 having a particle size of from 10 micrometers to 450 micrometers.

3. A composite particle according to claim 1 wherein said transition metal-containing bleach catalyst is selected from tile group consisting of $Mn^{IV}_2$(u-O)$_3$(1,4,7-trimethyl-1,4,7-triazacyclononane)$_2$-$(PF_6)_2$; $Mn^{III}_2$(u-O)(u-OAc)$_2$(1,4,7-trimethyl-1,4,7-triazacyclononane)$_2$-$(ClO_4)_2$; $Mn^{IV}_4$(u-O)$_6$(1,4,7-triazacyclononane)$_4$-$(ClO_4)_2$; $Mn^{III}Mn^{IV}_4$(u-O)(u-OAc)$_2$(1,4,7-trimethiyl-1,4,7-triazacyclononane)$_2$-$(ClO_4)_3$; Mn(1,4,7-trimethyl-1,4,7-triazacyclononane$(OCH_3)_3$-$(PF_6)$; Co(2,2'-bispyridylamine)$Cl_2$; trisdipyridylamine $Co^{II}$-perchlorate, Co-bispyridylmethane complex, Mn-bispyridylmethane complex, Co-bispyridylamine complex, Mn-bispyridylamine complex, Co(2,2'-bispyridylamine)$Cl_2$, Di(isothiocyanato)bispyridylamine-cobalt(II), Co(2,2'-bispyridylamine)$_2O_2ClO_4$, Bis-(2,2'-bispyridylamine) copper(II) perchlorate, tris(di-2-pyridylamine) iron(II) perchlorate, Mn gluconate, $Mn(CF_3SO_3)_2$, $[Co(NH_3)_5Cl]Cl_2$, $[Co(NH_3)_5OAc]Cl_2$, $[Co(NH_3)_5OAc](OAc)_2$ $[Co(NH_3)_5OAc](PF_6)_2$, $[Co(NH_3)_5OAc](SO_4)$, $[Co(NH_3)_5OAc](BF_4)_2$, $[Co(NH_3)_5OAc](NO_3)_2$, and mixtures thereof.

4. A composite particle according to claim 1 wherein said composite particle consists of between 50% and 98% of said encapsulating material.

5. A composite particle according to claim 1 wherein the encapsulating material is a low-bloom gelatin.

6. A composite particle according to claim 1 consisting of from 2% to 30% by weight of the metal-containing bleach catalyst.

7. A composite particle according to claim 4 wherein said composite particle consists of between 60% and 97% of said encapsulating material.

8. A composite particle according to claim 6 consisting of from 3% to 25%, by weight, of said bleach catalyst.

9. A composite particle according to claim 3 wherein said transition metal-containing bleach catalyst is $[Co(NH_3)_5OAc](NO_3)_2$.

* * * * *